US005206653A

United States Patent [19]

Westphal

[11] Patent Number: 5,206,653

[45] Date of Patent: Apr. 27, 1993

[54] SENSOR ARRANGEMENT FOR THE ACTIVATION OF AN ACTIVE BODY

[75] Inventor: Robert Westphal, Nuremberg, Fed. Rep. of Germany

[73] Assignee: Diehl GmbH & Co., Fed. Rep. of Germany

[21] Appl. No.: 889,455

[22] Filed: May 27, 1992

[30] Foreign Application Priority Data

May 31, 1991 [DE] Fed. Rep. of Germany ..... 4117873

[51] Int. Cl.[5] ..... G01S 13/00

[52] U.S. Cl. ..... 342/61; 102/427

[58] Field of Search ..... 342/61, 69, 68; 102/427

[56] References Cited

U.S. PATENT DOCUMENTS

| | | | |
|---|---|---|---|
| 3,509,791 | 5/1970 | Pechamat et al. | 102/427 |
| 3,924,233 | 12/1975 | Nastronero et al. | 342/69 |
| 4,196,433 | 4/1980 | Brown | 342/69 |
| 4,712,479 | 12/1987 | Babel | 102/427 |
| 4,761,652 | 8/1988 | Pirolli et al. | 302/427 |

FOREIGN PATENT DOCUMENTS

| | | |
|---|---|---|
| 0375872 | 7/1990 | European Pat. Off. . |
| 3625334 | 9/1989 | Fed. Rep. of Germany . |
| 2174482 | 11/1986 | United Kingdom . |

*Primary Examiner*—Mark Hellner

*Attorney, Agent, or Firm*—Scully, Scott, Murphy & Presser

[57] ABSTRACT

A sensor arrangement for the activation or starting of an active body, especially for a land mine which is deployed against ground and airborne targets. The arrangement includes a waking sensor which is responsive to the approach of a target, and incorporating circuit arrangements for the environmentally-adaptive setting of sensor-evaluating circuits in order to release the operating mechanism employed for combatting the target. Provided is at least one antenna for the radiating of a nondirectional electromagnetic ground or direct wave (which hugs the terrain), and possibly also for the receipt of reflections from the surroundings after the deployment of the active body, as well as after activation by the waking sensor, also for determining the relative movement of a target which has penetrated into the previously encompassed surroundings, due to the reflections thereon.

19 Claims, 1 Drawing Sheet

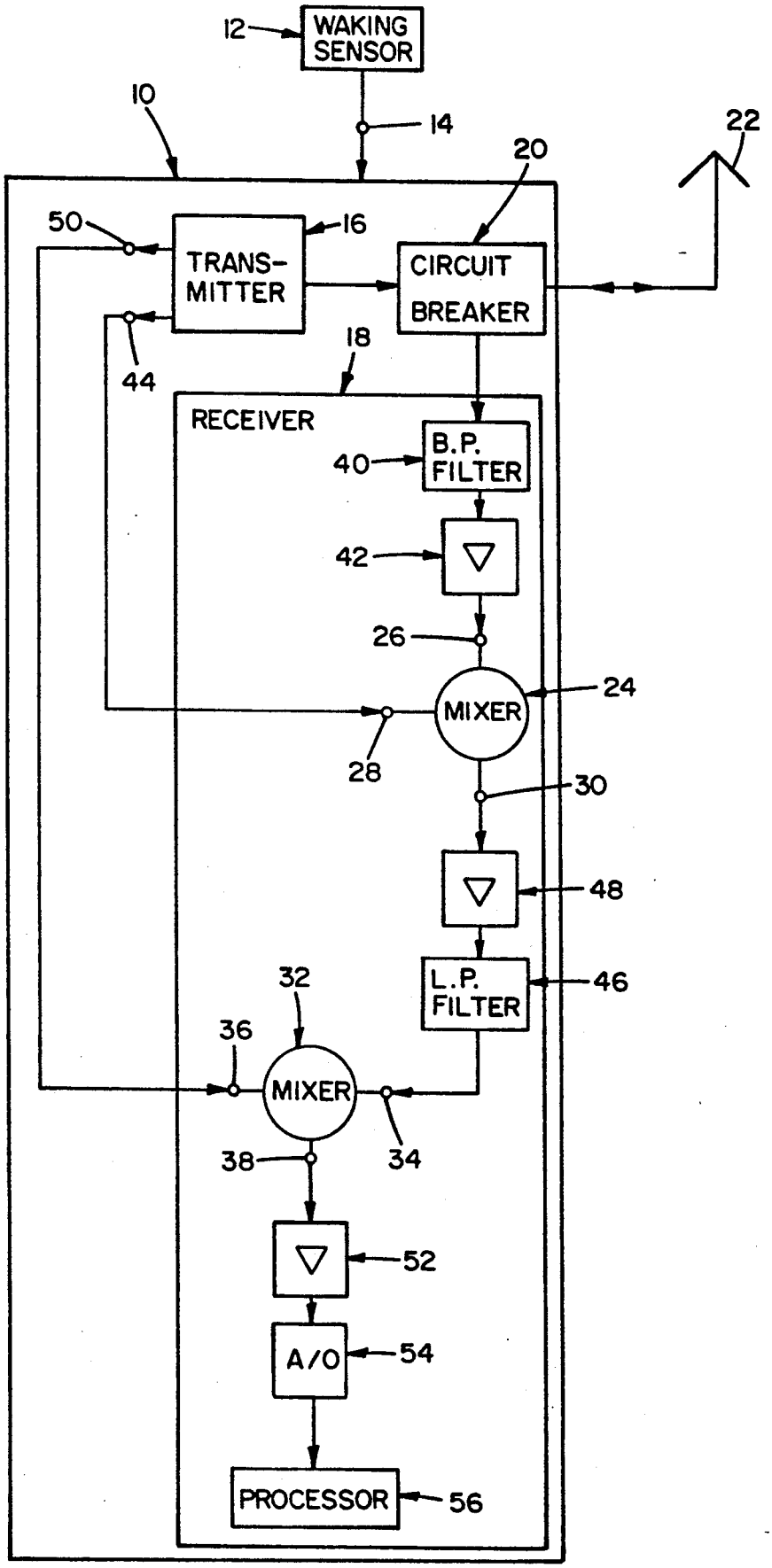
WAKING SENSOR
12
10
14
20
22
50
16
TRANS-MITTER
CIRCUIT BREAKER
44
18
RECEIVER
B.P. FILTER
40
42
26
MIXER
24
28
30
48
L.P. FILTER
46
32
36
MIXER
38
34
52
A/O
54
PROCESSOR
56

SENSOR ARRANGEMENT FOR THE ACTIVATION OF AN ACTIVE BODY

BACKGROUND OF THE INVENTION

1. Field of the Invention

The present invention relates to a sensor arrangement for the activation or starting of an active body, especially for a land mine which is deployed against ground and airborne targets, including a waking sensor which is responsive to the approach of a target, and incorporating circuit arrangements for the environmentally-adaptive setting of sensor-evaluating circuits in order to release the operating mechanism employed for combatting the target.

2. Discussion of the Prior Art

A sensor arrangement of that type is presently known from the disclosure of European Patent Appln. 03 75 872 A1 in the form of a seismic waking or approach sensor possessing a response threshold which is set in dependence upon the environmental conditions which are encountered at the locale of emplacement, especially the characteristics of the terrain so as to, on the one hand, avoid an excessively high rate in, signal errors and, on the other hand, to still be able to ensure a controllable degree of sensitivity with respect to specific targets or target objects In particular, the invention is directed to a sensor arrangement for a land mine possessing an operative mechanism for articles of submunition as disclosed in British Patent 2 174 482 A, the latter of which is commonly assigned to the assignee of the present application and the disclosure of which is incorporated herein by reference. In the instance of that patent, the waking sensor initiates the lifting up of the active body from a launch or starting apparatus, which remains stationarily in place, whereupon the active body again descends into the target area while suspended from a parachute, and searches the target area in a spirally-narrowing manner through the intermediary of a search head-sensor. Upon the detection of a target which is to be attacked, the search head causes the warhead which is equipped with a projectile-forming hollow charge-insert to be released in a direction towards the target or target object. In connection with this aspect, problems can be encountered in that, for the kinematics commencing from the response of the waking or activating sensor; in effect, for the ascent out of the starting or launch apparatus and for the braked-down rotational descent into the target area, there passes a period of time which is not adequately reducible, so that no effect can be achieved in the target object; for instance, when the latter only reaches or contacts the periphery in the range of detection for the alarm sensor and has already again distanced itself from the region which is detectable by the active body, when the active body after passing through its apogee finally again descends into the target area with an activated search head. As a consequence thereof, the raising out from the launch apparatus should, accordingly, only be initiated in such instances when the speed and the direction in the movement of the target is oriented in such a manner that the cylinder of the search head and active body during the descent thereof will also actually detect this target object within its effective range, possibly in the middle thereof. In contrast therewith, the active body should remain in its state of readiness to function when the probability is too low that the target object which has been detected by the waking sensor can also in actuality be defended against or warded off with a reasonably good chance of success in view of its motion vectors.

However, in this case, there can also be encountered problems in that the active body which is deployed either manually or by means of a mine thrower or launcher, should not lift up too high above the terrain due to camouflaging reasons, so that even low rises in the terrain or growths in the surroundings may obstruct the direct view towards the approaching target object. Simultaneously, it is intended that the individual active bodies contained in a mine should be able to communicate with each other, such that even upon the response of a plurality of waking or activating sensors there will be triggered the defense mechanism only at the location at which, due to the position relative to the momentary movement of the target, there is given the greatest prospect of success for the acquisition of the target during the phase of descent for the active body. Finally, for an optimizing in the utilization of the active body, it should also be of interest to not only determine the radial distance to and the speed of the approaching target, but also the direction towards the detected target object, so as to be able to derive therefrom; for example, a command transmission to a more expediently located mine, without necessitating installation of an apparatus for a laser-retromodulator system, such as is known from the disclosure of German Patent 36 25 334 C2.

SUMMARY OF THE INVENTION

In recognition of these conditions and for an increase in potentials, it is an object of the present invention to develop a sensor arrangement of the type under consideration that, even in the absence of any visual contact with the target, by means of simply constructed apparatus there can be determined at least the distance to and the speed of an approaching target object, so as to form the basis for optimizing the utilization; in particular, of an active body which is based on search head-equipped submunition.

The foregoing object is achieved for a sensor arrangement of the type under consideration herein in that, at a low height above ground, there is provided at least one antenna for the radiating of a nondirectional electromagnetic ground or direct wave (which hugs the terrain), and possibly also for the receipt of reflections from the surroundings after the deployment of the active body, as well as after activation by the waking sensor, also for determining the relative movement of a target which has penetrated into the previously encompassed surroundings, due to the reflections thereon.

The inventive sensor arrangement thus possesses the advantage that, with its relatively low overall constructional height; in essence, the positioning of the at least one antenna above ground, it is possible to obtain comparatively precise information concerning the target with respect to distance from the target and the speed of the target and; when required, also relative to the direction in the speed of the target which is to be attacked for the criterium in the triggering of the active body.

BRIEF DESCRIPTION OF THE DRAWING

Further details, features and advantages of the invention may now be more readily ascertained from the following description of an exemplary embodiment of a inventive arrangement for the triggering of an active body, as is illustrated in the single figure of drawing represented through a block circuit diagram.

DETAILED DESCRIPTION

The single figure of drawing illustrates, in the block circuit diagram, a sensor arrangement 10 which operates pursuant to the principle of a pulse-doppler radar, which is operatively connected with a waking or activating sensor 12 which connection is indicated by the arrow 14. With respect to the waking or activating sensor 12, the latter may relate to an acoustic sensor and/or a sensor which is responsive to seismic signals.

The sensor arrangement 10 possesses a transmitter 16 and a receiver 18 whereby, for the generating of a pulse-modulated transmitting signal, the transmitter 16 possesses a pulse modulator and a coherent oscillator. The transmitter 16 and the receiver 18 are decoupled through the interposition of a protective circuit breaker 20 for the receiver. The at least one antenna is identified by the reference numeral 22. With respect to the antenna, the latter relates; for instance, to a horizontal polarized yagi antenna, or relates to a rod or ship antenna. In the illustrated example, the antenna 22 serves as a transmitting antenna as well as a receiving antenna. However, it is also possible to associate the transmitter 16 and the receiver 18 each with its own antenna.

The receiver 18 possesses a first receiving mixer 24 having a first input 26, a second input 28, an intermediate-frequency signal output 30; as well as a second receiving mixer 32 having a first input 34, a second input 36 and an output 38.

The protective circuit breaker 20 for the receiver is connected with the first input 26 of the first receiving mixer 24 through a band-pass filter 40 and a low-noise preamplifier 42. The second input 28 of the first receiving mixer 24 is connected with a feedback-mixing signal output 44 of the transmitter 16. The intermediate-frequency signal output 30 of the first receiving mixer 24 is connected through a low-pass filter 46 and an amplifier 48 with the first input 34 of the second receiving mixer 32. The second input 36 of the second receiving mixer 32, which may pertain to a bipolar video signal-generating quadrature detector, is connected with an intermediate-frequency signal output 50 of the transmitter 16.

The output 38 of the second receiving mixer 32 is connected through a video amplifier 52 and an A/D converter system 54 with a signal processor 56.

The inventive sensor arrangement 10 is adapted for deployment as a mine sensor against ground targets and airborne targets, and which functions at a low height above ground for the determination of the radial distance to the target and the radial speed of the target. Hereby, there can present a visual contact with the target which is to be attacked; however, this is not absolutely necessary. Optionally, there can also be determined the direction of the target in azimuth and elevation. The sensor arrangement 10 operates in accordance with the principle of a pulse-doppler radar operating with a frequency within either the HF-, VHF-UHF- or Microwave range. As has been already mentioned, for the determination of the distance to the target and the speed of the target, there is required at least one antenna 22. If, in addition, there should be also determined the direction of the target, then there are required at least three antennae 22.

Through the above-mentioned pulse modulator and coherent oscillator of the transmitter 16, in an exemplary embodiment of the sensor arrangement 10, there is generated a pulse-modulated transmission signal at a frequency of 1,000 MHz. The transmitting pulses are radiated by means of a beam antenna or omnidirectional antenna 22. The transmitter 16 and the receiver 18 are decoupled during the transmission of the transmitting pulses by means of the protective circuit breaker 20 of the receiver.

The echo signal which is reflected by the surrounding ground clutter and by potential targets, is conducted through the at least one antenna 22 into the receiver 18. In the latter, the receiving signal is initially band pass-filtered (at 40) and then passes through a low-noise preamplifier 42 having a median frequency of 1000 MHz.

In the following receiving mixer 24, the signal is coherently converted at the output 30 with a feedback mixing signal (at 44 or, respectively, 28) from 880 MHz to an interim frequency of 120 MHz.

Inasmuch as all transmitting and receiving oscillators are bound phase-coupled to a common 10 MHz reference source, the entire system is coherent.

The interim frequency signal of 120 MHz at the output 30 of the first receiving mixer 24 is then raised to the required signal level in a following amplifier 48, and then low pass-filtered by means of the low-pass filter 46 which possesses a limiting frequency of 200 MHz This interim frequency signal of 120 MHz which is encountered at the first input 34 is then mixed in the second receiving mixer 32 with a signal of 120 MHz which is present at the intermediate-frequency signal output 50 of the transmitter 16. Generated in the second receiving mixer 32 is a bipolar video signal, which appears at the output 38 of the second receiver mixer 32. In accordance with the type of construction of the sensor arrangement 10, the signal at the output 38 is either single-channeled or two-channeled, consisting of the constituents of in-phase signal and quadrature signal.

The signal at the output 38 of the second receiving mixer 32 is brought up to the required signal level by means of a video amplifier 52, and then transmitted to an A/D converter system 54. This analog-digital converter system consists of a one to two rapid analog-digital converters. The scanning frequency is designed to the pulse duration. In the described exemplary embodiment, the scanning frequency, in accordance with the pulse duration of 50 ns, consists of a minimal 20 MHz.

The digitalized receiving signal is then further processed in the signal processor 56 which is connected to the output of converter system 54.

In the employment of the sensor arrangement 10 in an intelligent mine system, the sensor arrangement 10 is initially passive. The arrangement is activated through a simply constructed waking or activating sensor 12 which; for example, may pertain to an acoustic sensor or to a seismic sensor. In this manner, the mine is detectable and locatable only with extreme difficulty, inasmuch as the transmitter 16 operates merely for a short period of time over a few ms.

After the setting up of the mine at the intended location, the sensor arrangement 10 is initially activated once, so that it can implement a so-called clutter adaptation. This clutter adaptation consists in the measurement of the time-invariant signal echo of the surroundings. These time-invariant echo signals are then stored in the signal processor 56. Thereafter, the sensor arrangement 10 is switched into its passive condition. Thus, when a potential target moves within the range of the sensor arrangement 10 past the latter either in the air; for example, such as a helicopter, or on the ground; for example, such as an armed vehicle which is to be attacked, the sensor arrangement 10 is then activated by means of the waking sensor 12 which is connected ahead thereof.

For the attacking of airborne targets, there is implemented a determination of the direction of approaching flight in azimuth and elevation in accordance with the interferometer principle. For this purpose, as has been previously mentioned, it is necessary to employ at least three antennas 22. The direction-finding determination can hereby also be implemented pursuant to the doppler-radar principle with a plurality of antennas 22 on a partial basis.

In other electrical configurations of the transmitting frequency; namely, within the microwave range, the sensor arrangement 10 is adapted for the analysis of threats from armored motorized troops.

What is claimed is:

1. Sensor arrangement for an active body, such as a land mine deployed against ground and airborne targets; including a waking sensor responsive to the approach of a target to activate the arrangement, and a circuit arrangement for the surroundings-adaptive setting of sensor-evaluating circuits for the release of an operative mechanism for combatting the target, said arrangement comprising at least one antenna extending to a low height above ground, which subsequent to activation by the waking sensor radiates an omnidirectional electromagnetic ground wave and receives reflections from the encompassing surroundings, and for determining by reflected radiation from a target the relative movement of a target which has penetrated the encompassing surroundings.

2. Sensor arrangement as claimed in claim 1, wherein the arrangement includes a transmitter and a receiver, said sensor arrangement determining at least the distance from and the speed of a target which is to be attacked; a common antenna operatively interconnecting said transmitter and receiver; and a protective circuit breaker for said receiver uncoupling said transmitter and said receiver.

3. Sensor arrangement as claimed in claim 1, wherein said arrangement includes a transmitter and a receiver, said sensor arrangement determining at least the distance from and the speed of a target which is to be attacked; and a separate antenna being associated with respectively said transmitter and receiver.

4. Sensor arrangement as claimed in claim 2, wherein the sensor arrangement operates pursuant to the principle of a pulse-doppler radar, said transmitter including a pulse modulator and a coherent oscillator for the generating of a pulse-modulated transmitting signal.

5. Sensor arrangement as claimed in claim 3, wherein the sensor arrangement operates pursuant to the principle of a pulse-doppler radar, said transmitter including a pulse modulator and a coherent oscillator for the generating of a pulse-modulated transmitting signal.

6. Sensor arrangement as claimed in claim 1, wherein the sensor arrangement comprises means for the transmission and for the receipt of a frequency-modulated continuous-wave signal.

7. Sensor arrangement as claimed in claim 1, further including a field comprising a plurality of said active bodies, and wherein the sensor arrangement comprises a wireless communication system among said plurality of active bodies in said field of said active bodies.

8. Sensor arrangement as claimed in claim 1, including at least three antennas for determining the distance from, the speed of, and the direction of movement of a target which is to be attacked.

9. Sensor arrangement as claimed in claim 2, wherein the receiver connects a first receiving mixer and a second receiving mixer with a first input to a protective circuit breaker of the receiver, connects with a second input to a feedback mixing signal output of the transmitter and connects with an intermediate-frequency signal output to a first input of the second receiving mixer, said second receiving mixer having a second input connected with an intermediate-frequency signal output of the transmitter and an output which is connected with a signal processor, the signal frequency at the intermediate-frequency signal output at the second input of the second receiving mixer and the signal frequency at the intermediate-frequency signal output of the first receiving mixer and the signal frequency at the intermediate-frequency signal output of the transmitter being correlated with each other.

10. Sensor arrangement as claimed in claim 9, wherein the protective circuit breaker for the receiver is connected through a band-pass filter and a low-noise preamplifier with the first input of the first receiving mixer.

11. Sensor arrangement as claimed in claim 9, wherein the intermediate-frequency signal output of the first receiving mixer is connected through a low-pass filter and an amplifier with the first input of the second receiving mixer.

12. Sensor arrangement as claimed in claim 9, wherein the second receiving mixer is a mixer or a bipolar video signal-generating quadrature detector.

13. Sensor arrangement as claimed in claim 9, wherein the output of the second receiving mixer is connected through a video amplifier and an A/D converter system with a signal processor.

14. Sensor arrangement as claimed in claim 3, wherein the receiver connects a first receiving mixer and a second receiving mixer with a first input to a protective circuit breaker of the receiver, connects with a second input to a feedback mixing signal output of the transmitter and connects with an intermediate-frequency signal output to a first input of the second receiving mixer, said second receiving mixer having a second input connected with an intermediate-frequency signal output of the transmitter and an output which is connected with a signal processor, the signal frequency at the intermediate-frequency signal output at the second input of the second receiving mixer and the signal frequency at the intermediate-frequency signal output of the first receiving mixer and the signal frequency at the intermediate-frequency signal output of the transmitter being correlated with each other.

15. Sensor arrangement as claimed in claim 14, wherein the protective circuit breaker for the receiver is connected through a band-pass filter and a low-noise preamplifier with the first input of the first receiving mixer.

16. Sensor arrangement as claimed in claim 14, wherein the intermediate-frequency signal output of the first receiving mixer is connected through a low-pass filter and an amplifier with the first input of the second receiving mixer.

17. Sensor arrangement as claimed in claim 14, wherein the second receiving mixer is a mixer or a bipolar video signal-generating quadrature detector.

18. Sensor arrangement as claimed in claim 14, wherein the output of the second receiving mixer is connected through a video amplifier and an A/D converter system with a signal processor.

19. Sensor arrangement as claimed in claim 1, wherein the waking sensor is a sensor which is sensitive to acoustic and/or seismic signals.

* * * * *